United States Patent [19]

Goade et al.

[11] Patent Number: 5,007,805

[45] Date of Patent: Apr. 16, 1991

[54] REVERSIBLE VARIABLE DISPLACEMENT HYDRAULIC DEVICE

[75] Inventors: James C. Goade, Joliet, Ill.; Claude H. Werner, Manhattan, Ill.

[73] Assignee: Caterpillar Inc., Peoria, Ill.

[21] Appl. No.: 548,808

[22] Filed: Jul. 2, 1990

[51] Int. Cl.[5] ..... F04B 49/00; F04B 1/30; F01B 13/04

[52] U.S. Cl. ..... 417/216; 417/222; 417/270; 91/505

[58] Field of Search ..... 417/269, 270, 271, 222, 417/218, 212, 217, 220, 216; 92/12.2; 91/499, 504, 505, 506

[56] References Cited

U.S. PATENT DOCUMENTS

| | | | |
|---|---|---|---|
| 3,643,550 | 2/1972 | Lease | 91/506 |
| 4,028,010 | 6/1977 | Hopkins | 417/217 |
| 4,205,590 | 6/1980 | Stegner | 91/506 |
| 4,248,137 | 2/1981 | Caruso | 91/506 |
| 4,379,389 | 4/1983 | Liesener | 417/216 |
| 4,381,646 | 5/1983 | Ruseff et al. | 417/222 |
| 4,466,337 | 8/1984 | Eiler | 91/506 |
| 4,478,136 | 10/1984 | Heiser et al. | 91/506 |

FOREIGN PATENT DOCUMENTS

3711037A1 10/1988 Fed. Rep. of Germany .

OTHER PUBLICATIONS

Pages 20–23 of a Technical Description, dated 1983 and published by Linde Hydraulic.

*Primary Examiner*—Leonard E. Smith
*Assistant Examiner*—John A. Savio, III
*Attorney, Agent, or Firm*—John W. Grant

[57] ABSTRACT

Reversible, variable displacement, hydraulic devices are useful in transmitting power from an engine to a driven device. The hydraulic components of such devices are generally quite bulky and difficulty to center to swash plate thereof. The subject device includes a pair of servo valves adjustably disposed within a case for individually controlling the flow of actuating fluid to and from a pair of hydraulic servo actuators. A servo feedback mechanism is provided to mechanically move a valve spool of one of the servo valves to a position for exhausting fluid from one of the servo actuators as the spool of the other servo valve is moved to a position for directing actuating fluid to the other of the servo actuators. The feedback mechanism also moves the spools substantially to their neutral position when a swash plate controlled by the servo actuators reaches a desired angular position after the other spool is first moved to the position for directing actuating fluid to the other servo actuator. The feedback mechanism is compact and cooperates with the adjustability of the servo valves so that centering of the swash plate is simplified.

38 Claims, 6 Drawing Sheets

REVERSIBLE VARIABLE DISPLACEMENT HYDRAULIC DEVICE

TECHNICAL FIELD

This invention relates generally to a reversible variable displacement hydraulic device and more particularly to a mechanism for controlling the displacement thereof and the direction of fluid flow therethrough.

BACKGROUND ART

Many reversible, variable displacement, axial piston pumps have a pivotal swash plate to both change the direction of delivery of hydraulic fluid from the pump and to adjust the displacement of the pump. Some of these variable displacement pump designs use a pair of opposed operating hydraulic servo actuators to control the position of the swash plate. Usually those variable displacement pumps have some sort of servo valve mechanism for controlling the flow of pressurized pilot fluid to and from the servo actuators wherein the servo valve mechanism is returned to a position so that the swash plate is maintained at a position corresponding to an input force or pressure applied to the servo valve mechanism.

The recent trend in pump controls is to use either pilot or electro-hydraulic control of the servo valve mechanism. The servo valve mechanism of those pumps generally includes a valve spool slidably disposed in a moveable sleeve which is either connected to the swash plate directly or through a linkage. One pilot operated system for controlling the servo mechanism has a pair of servo pistons for rotating a lever which in turn moves the valve spool in the appropriate direction depending upon which one of the servo pistons is actuated. Moving the valve spool directs pressurized fluid to one of the servo actuators to pivot the swash plate for changing the displacement and direction of delivery of the pump. The pivotal movement of the swash plate in turn moves the sleeve to a blocking position to stop the fluid flow to the servo actuator, thereby causing the swash plate to stop and be held at a desired position. One of the disadvantages of such servo valve mechanisms is that very tight tolerances must be held on the valve spool and sleeve thereby increasing the manufacturing cost of the pump. Moreover, the forces required to move the spool through such lever arrangement necessitates the use of relatively large servo pistons and relatively stiff springs to center the servo pistons in their neutral position. Such servo valve mechanisms require numerous adjustments to the servo mechanism after all the pump components are assembled, thereby increasing the complexity of adjusting the swash plate to the centered or zero displacement position. Furthermore, the fluid commonly used for powering the hydraulic actuators is low pressure pilot fluid. This results in a disadvantage since the servo actuators must be relatively large to provide sufficient force to overcome the swivel torques exerted by the pump pistons.

The servo valve mechanisms of some reversible variable displacement pumps are combined in cartridge form with one of the hydraulic actuators. Such servo valve mechanisms are complicated and difficult to adjust to the centered position of the swash plate.

The present invention is directed to overcoming one or more of the disadvantages or problems as set forth above.

DISCLOSURE OF THE INVENTION

In one aspect of the present invention, a reversible, variable displacement, hydraulic device has a case and a drain cavity defined by the case, an angularly adjustable swash plate resiliently biased to a centered position and moveable in a clockwise direction from the centered position to control the displacement of the device in a first direction of operation and in a counterclockwise direction from the centered position to control the displacement of the device in a second direction of operation, first actuator means for angularly moving the swash plate in the clockwise direction, and second actuator means for angularly moving the swash plate in counterclockwise direction. The device comprises first and second servo valve means for controlling communication of hydraulic actuating fluid to the first and second actuator means, respectively, an elongate feedback plate pivotally connected to the case and having opposite end portions disposed in operational contact with the first and second servo valve means, a "T" shaped follow-up lever pivotally connected to the case and having a pair of arms spaced from the end portions of the feedback plate, a pair of springs disposed between the arms of the lever and the end portions of the plate and means for connecting the lever to the swash plate so that the lever is pivoted in response to angular movement of the swash plate.

The present invention provides a reversible variable displacement hydraulic device which permits a greater range of tolerances in the manufacturing of the various components of the control mechanism and which is simple to adjust to compensate for the greater tolerances. Using the pair of servo valves to individually control communication of fluid to and from the pair of separate servo actuators in combination with a feedback mechanism, which includes the feedback plate, the follow-up lever, the springs, and connecting means, contributes to the simplicity of the device and enhance the adjustability of the mechanism for centering the swash plate. Finally, the construction of the feedback mechanism reduces the forces required to actuate the servo valves so that the servo valves can be easily controlled in a variety of ways, i.e. pilot operated, electro hydraulically operated, direct solenoid operated, and so forth.

BEST MODE FOR CARRYING OUT THE INVENTION

Figure 1:
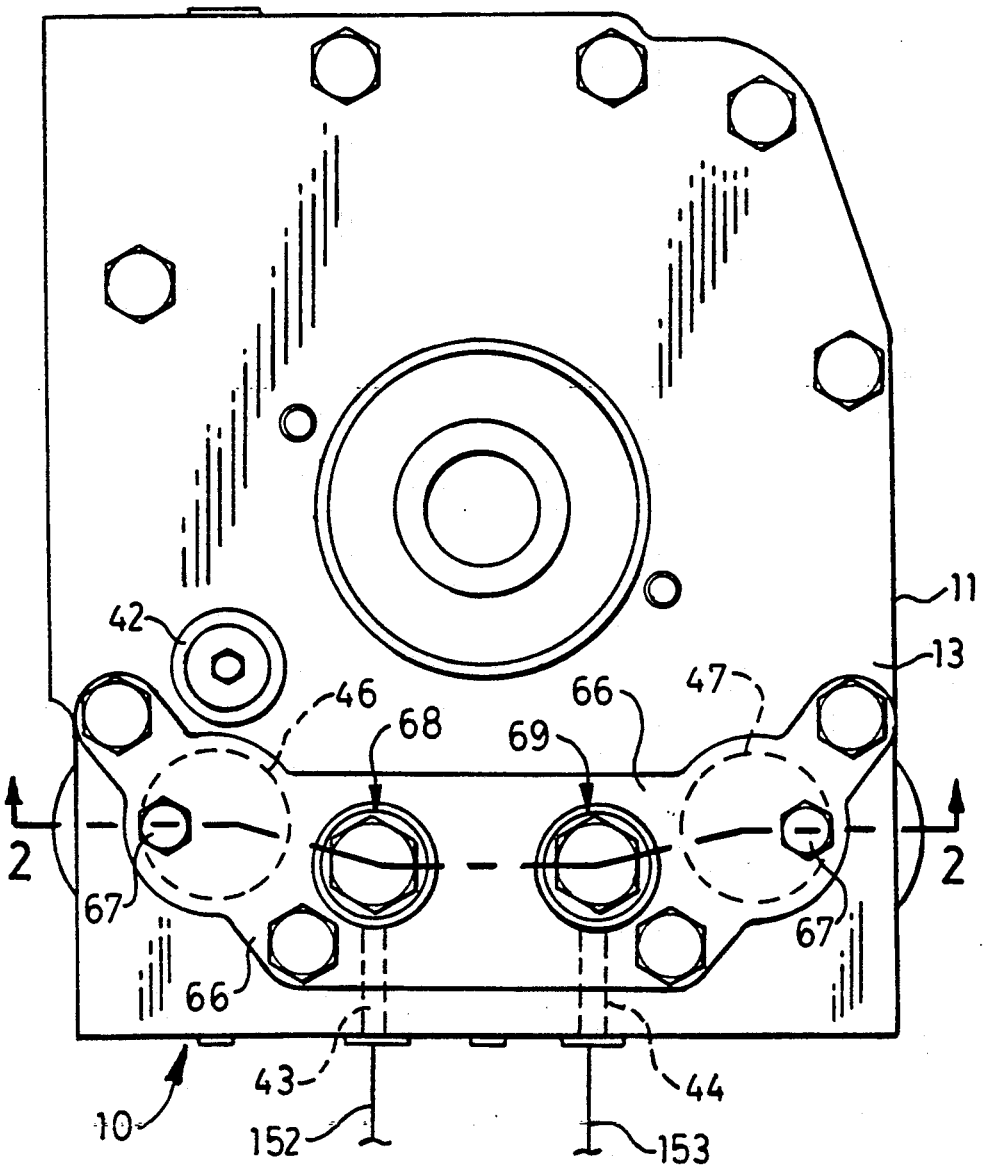
FIG. 1 is a plan view of an embodiment of the present invention.

Referring to the drawings, a reversible, variable displacement, axial piston hydraulic device is indicated at 10 and can be used either as a hydraulic pump or a hydraulic motor. The device 10 will be described and referred to as pump 10. The pump !0 includes a multipiece case 11 generally including a lower body 12 and an upper head 13 connected thereto defining a case drain cavity 14 therein which is suitably connected to a reservoir (not shown). A pump cylinder barrel 16 is located within the cavity !4 and has a plurality of reciprocally mounted pistons 17 therein. A timing port plate 18 is suitably disposed between the barrel 16 and the head 13 and is nonrotatably connected to the head. The pistons 17 are guided by a slipper pad assembly 19 operatably associated with a nonrotatable but angularly adjustable swash plate 21 in the usual manner. The swash plate 21 is pivotal about a transverse axis 22 by a pair of pivot pins 23 suitably connected to the body 12 in the usual manner. The swash plate has a hole 26 opening toward the head 13 and a pair of lugs 27 extending outwardly from opposite sides thereof. The barrel 16 is drivingly connected to a driveshaft 28 rotatably supported by a pair of bearings 29,31 seated in a pair of coaxial aligned bores in the body 12 and head 13 respectively.

The head 13 includes a pair of vertically oriented spaced apart parallel actuator receiving bores 32,33 and a pair of vertically oriented spaced apart parallel stepped valve receiving bores 34,35 extending therethrough. Each of the valve receiving bores 34,35 has a threaded portion 37 at the upper end thereof. A pair of discharge/intake ports are illustrated at 38,39 in FIG. 3. An actuator supply passageway, diagrammatically shown at 41 in FIGS. 2 and 3 for illustrative convenience, communicates with the valve receiving bores 34,35 and with the discharge/intake ports 38,39 through a resolver 42. A pair of pilot fluid passages 43,44 open into the valve receiving bores 34,35.

Figure 5:
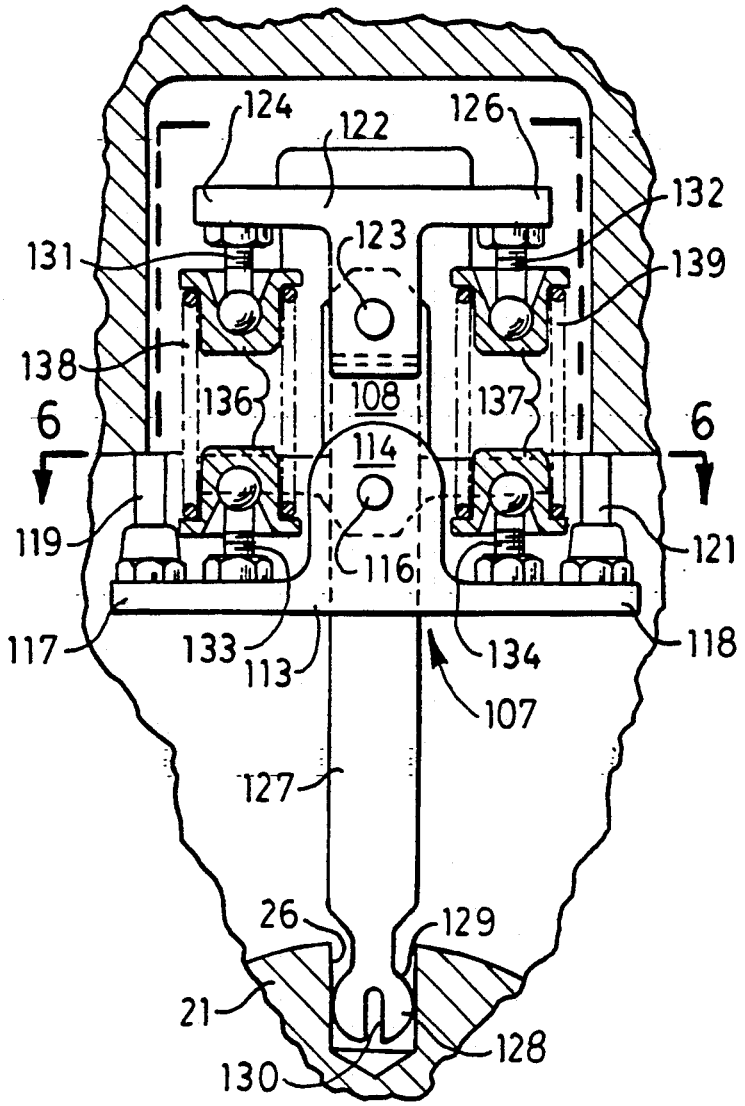
FIG. 5 is a somewhat enlarged sectional view taken generally along line 5—5 of FIG. 3.

A pair of cartridge type hydraulic servo actuators 46,47 are disposed in the actuator receiving bores 32,33. The servo actuator 47 provides an actuator means for moving the swash plate 21 in a clockwise direction when pressurized fluid is directed thereto while the servo actuator 46 provides an actuator means for moving the swash plate in the counterclockwise direction as viewed in FIGS. 2 and 5 when pressurized fluid is directed thereto. The servo actuators 46,47 are identical in construction and thus only the servo actuator 47 will be described in detail with identical reference numerals applied to both actuators. The actuator 47 includes a body 48 seated in the actuator receiving bore 33 and having a stepped outer cylindrical surface 49 defining a pair of annular chambers 52,53 within the bore. The body 48 includes a stepped bore 54 opening toward one of the lugs 27 of the swash plate 21 and slidably receives an actuator piston 56 which cooperates with the body to define a variable volume actuating chamber 57. A coil compression spring 58 is disposed in the actuating chamber 57 between the piston 56 and a spring seat 59 normally in contact with an annular shoulder 61 of the body 48. A lighter weight, anti-rattle spring 62 is positioned between the body 48 and a recessed portion 63 of the spring seat. A push rod 64 extends between the piston 56 and the appropriate lug 27 of the swash plate 21. A retainer 66 is suitably fastened to the head 13 with each body 48 being retained in the respective bore and in abutment with the retainer by a bolt 67.

A pair of cartridge type pilot actuated servo valves 68,69 are individually disposed in the valve bores 34,35, respectively. The servo valves provide a servo valve means for controlling communication of actuating fluid to the servo actuators 46,47. The servo valves 68,69 are identical in construction and thus, the construction of servo valve 69 more clearly shown on FIG. 4 will be described in detail with identical reference numerals applied to both valves. The servo valve 69 includes a valve body 71 seated in the valve receiving bore 35. The body 71 has a stepped outer cylindrical surface 72 which cooperates with the head 13 to define a plurality of axially spaced annular chambers 73,74,75. An upper end portion 77 of the body is threaded and threadably engages the threaded portion 37 of the bore 35. An axially extending stepped bore 78 is provided in the valve body with an upper end portion 79 being threaded. Three pair of radially extending passages 81,82,83 in the body 71 communicate the annular chambers 73,74,75, respectively, with the stepped bore 78. The valve body 71 is retained at a fixed position relative to the head by a lock nut 80.

A valve spool 84 is slidably disposed in the lower portion of the bore 78 and has an annular groove 86 and a reduced diameter portion 87 separated by a fluid control land 88. A socket 89 is recessed into the lower end of the valve spool. A threaded stud 91 is screwed into the threaded end portion 79 of the bore and cooperates with the valve body and the valve spool to define an actuating chamber 92 in the bore 78. The stud 91 is locked at a fixed axial location relative to the valve body with a lock nut 93. A biasing means 94 is disposed within the actuating chamber 92 between the stud 91 and the valve spool for resiliently resisting movement of the valve spool toward the stud. The biasing means includes a coil compression spring 96 captured between a spring guide 97 and a cup shaped retainer 98. The spring guide 97 has an annular head 99 normally in abutment with the valve spool and a stem 101 extending upwardly from the head 99 through the coil spring 96. The cup shaped retainer 98 has a hole 102 Which slidably receives the stem 101. The retainer 98 is retained on the stem 101 by a bolt 103 to maintain the spring 96 in a preloaded condition and to permit the stem to move upwardly relative to the retainer. The retainer 98 is normally in abutment with the stud 91.

Figure 2:
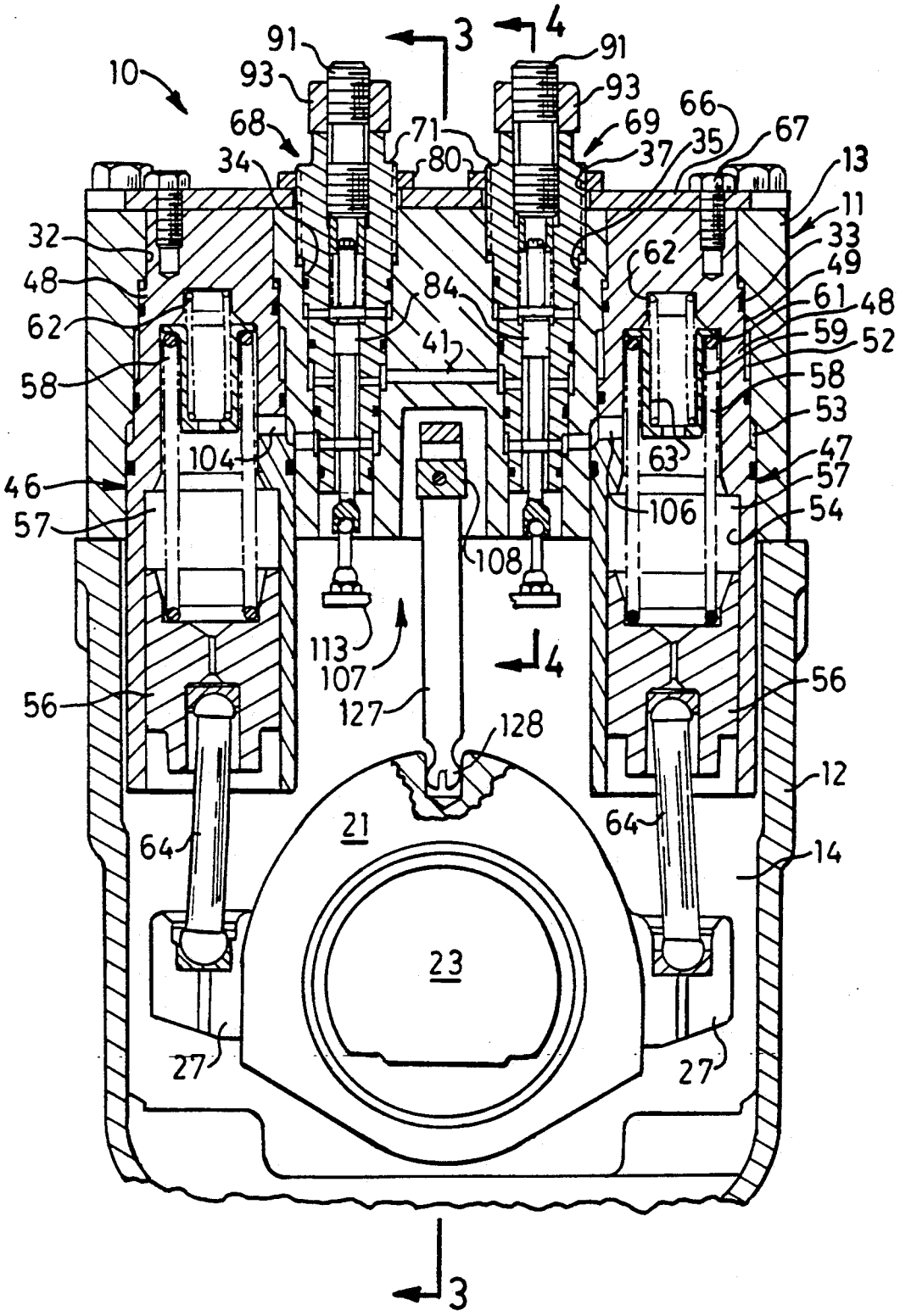
FIG. 2 is a sectional view taken generally along line 2—2 of FIG. 1.
Figure 3:
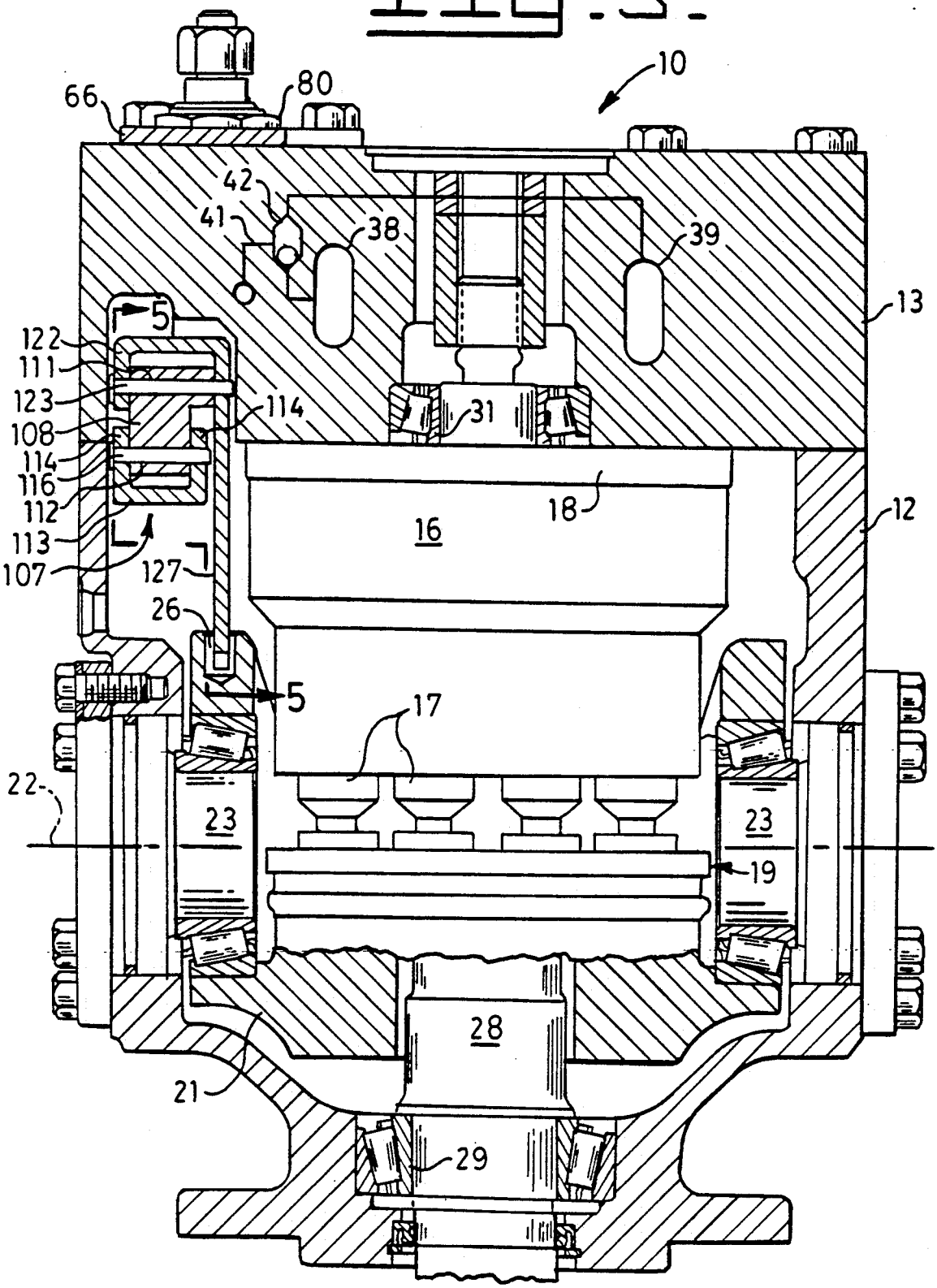
FIG. 3 is a sectional view taken generally along line 3—3 of FIG. 2.

A pair of control passageways 104,106 as shown in FIG. 2 respectively connect the annular chambers 75 of the servo valves 68,69 with the actuating chambers 57 of the servo actuators 46,47. The pilot fluid passages 43,44 communicate with the annular chambers 73 of the servo valves 68,69 respectively. The actuator supply passage 41 communicates with the annular chambers 74 of the servo valves 68,69.

Figure 4:
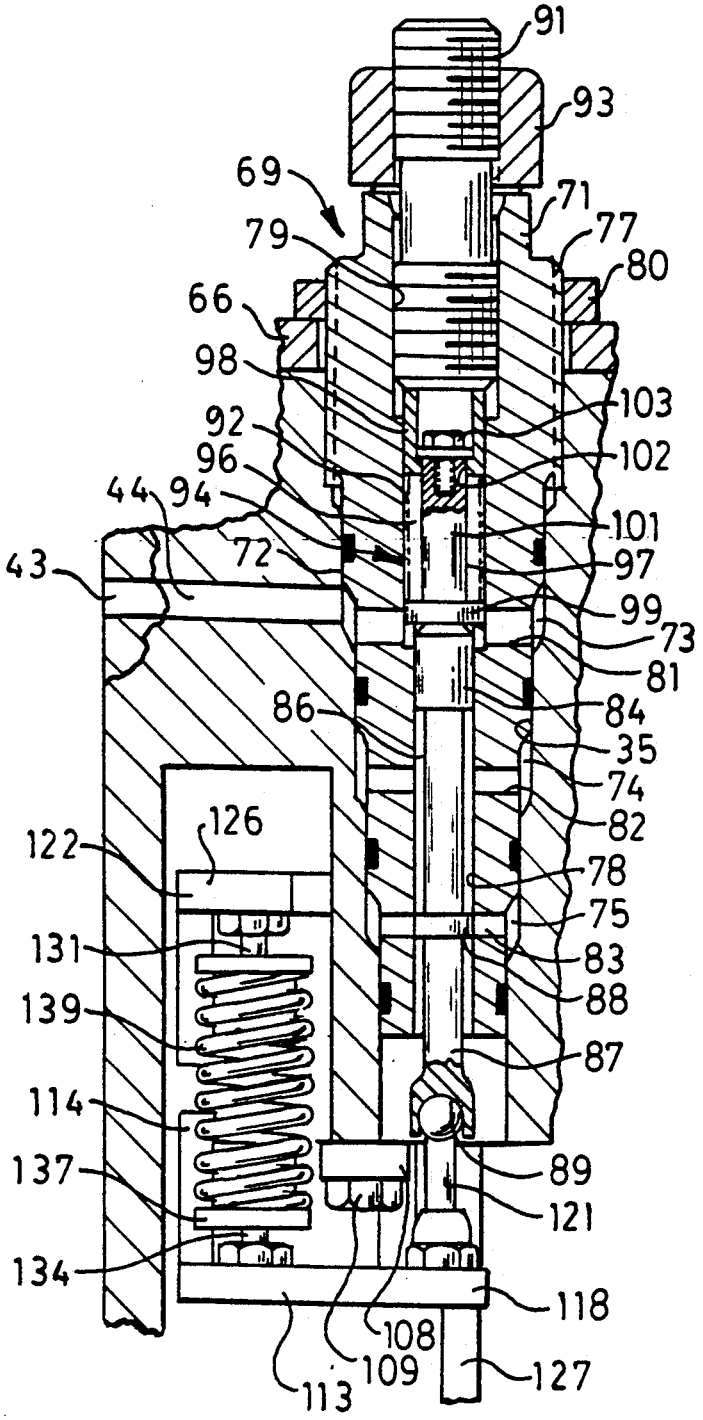
FIG. 4 is a somewhat enlarged sectional view taken generally along line 4—4 of FIG. 2.
Figure 6:
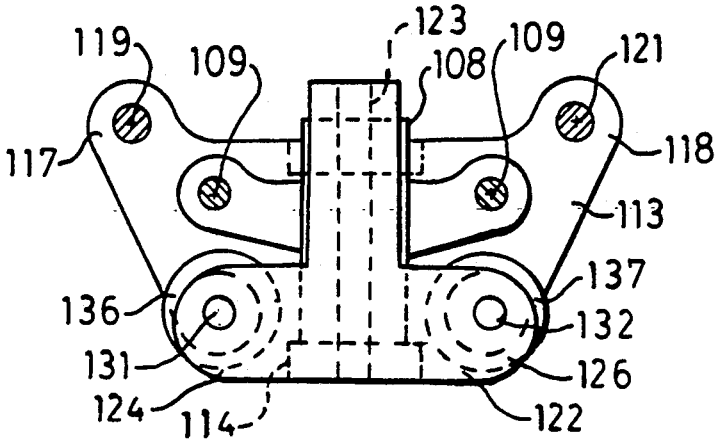
FIG. 6 is a somewhat enlarged sectional view taken generally along line 6—6 of FIG. 5.

A servo feedback mechanism 107 includes a support bracket 108 connected to the head 13 by a pair of bolts one shown at 109 of FIG. 4 and has a pair of parallel bores 111,112 extending therethrough. A generally elongate feedback plate 113 has a pair of centrally disposed spaced apart protruding ears 114 straddling the support bracket 108 and is pivotally connected thereto by a pivot pin 116 extending through the bore 112. The feedback plate has opposite end portions 117,118. A pair of push rods 119,121 are connected to the end portions 117,118, respectively, with the upper ends of the push rods being seated in the sockets 89 of the valve spools 84 to mechanically connect the valve spools 84 to the feedback plate 113. Thus movement of one of the spools 84 in either direction results in the other spool moving in the opposite direction an equal amount. A "T" shaped lever 122 is pivotally connected to the support bracket 108 by a pivot pin 123 extending through the bore 111. The lever 122 has a pair of outwardly extending arms 124,126, spaced above the end portions 117,118, respectively. A shank 127 of the lever 122 terminates at an end portion 128 having a cylindrical shaped surface 129 slidably seated in the hole 26 of the swash plate 21. The end portion 128 is slightly larger than the hole 26 and has a notch 130 formed therein to provide a spring effect when the end portion 128 is inserted into the hole. A pair of spherical ended studs 131,132 are secured to the arms 124,126 and extend downwardly toward the end portions 117,118. Similarly, a pair of spherical ended studs 133,134 are secured to the end portions 117,118 and extend upwardly toward the studs 131,132, respectively. A first pair of spring retainers 136 are seated on the studs 131,133, while another pair of spring retainers 137 are seated on the studs 132,134. A pair of compression springs 138,139 are individually disposed between each pair of spring retainers 136,137. When the feedback mechanism 107 is in the position shown in the drawings, both springs 138,139 are in a partially compressed condition.

Figure 7:
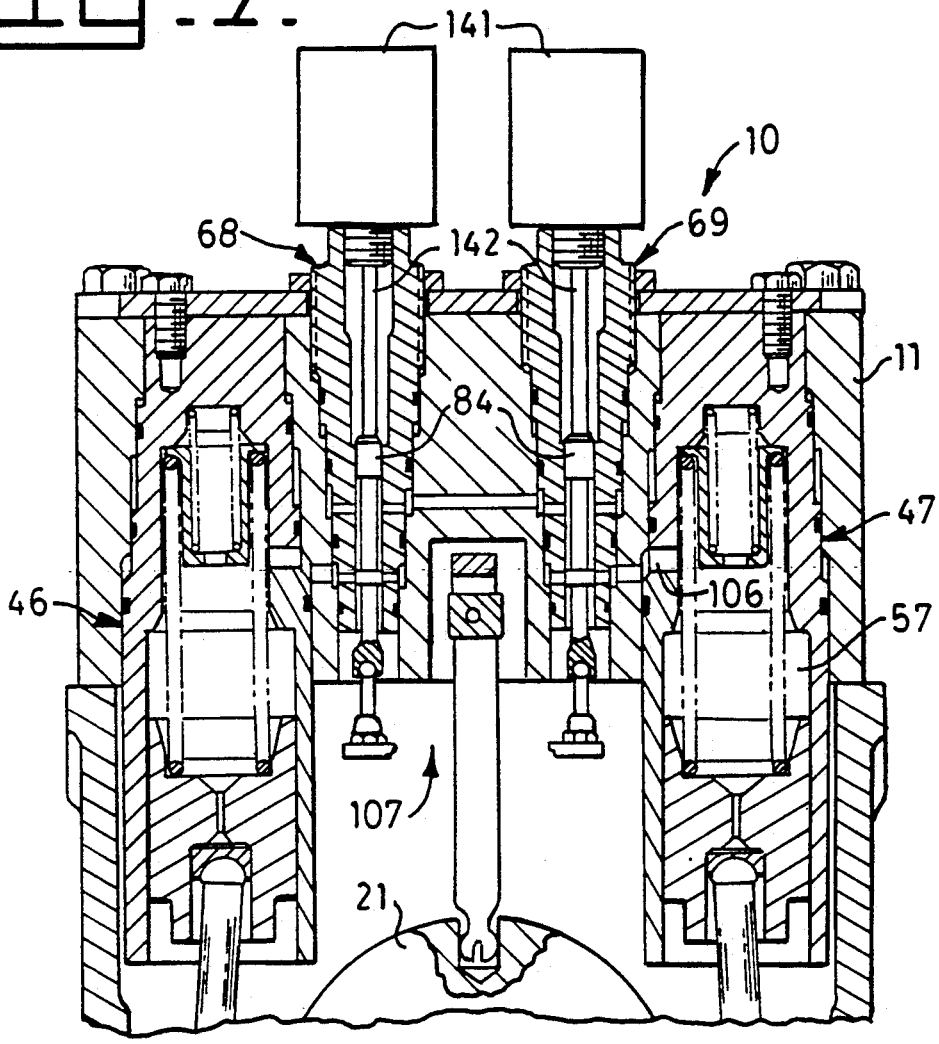
FIG. 7 is a view similar to FIG. 2 but showing another embodiment of the present invention.

Another embodiment of the reversible variable displacement hydraulic device is shown on FIG. 7. It is noted that the same reference numerals of the first embodiment are used to designate similarly constructed counterpart elements of this embodiment. In this embodiment, however, the servo valves 68,69 are solenoid actuated with each valve including an electrically energized proportional force solenoid 141 threadably engaging the threaded end portion 79 of the valve body 71. The solenoid 141 includes a stem 142 extending downwardly into engagement with the valve spool 84.

Figure 8:
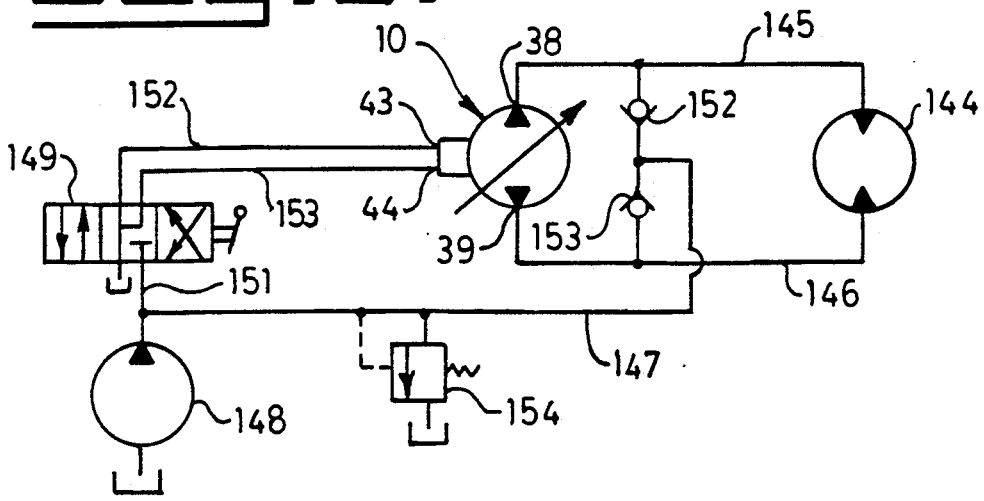
FIG. 8 is a schematic illustration of the embodiment of this invention in a hydraulic circuit.

FIG. 8 schematically shows the discharge/intake ports 38,39 of the pump 10 connected to a hydraulic motor 144 through a pair of conduits 145,146 in a typical closed loop fashion. A combined pilot and charging circuit 147 is connected thereto and includes a fixed displacement pump 148 connected to a manually operated pilot control valve 149 through a main supply line 151. A pair of pilot lines 152,153 connect the pilot valve to the pilot fluid passages 43 and 44, respectively of the pump 10. The supply line 151 is also connected to the conduits 145,146 through a pair of check valves 154,155 in the usual manner. A relief valve 156 is connected to the main supply line and under normal operating conditions maintains the pressure level of the fluid in the supply line 151 at a predetermined level. The check valves permit fluid to pass from the main supply line into the conduits as required to maintain the pressure level in one or both of the conduits at least as great as the predetermined pressure level.

Industrial Applicability

Operation of the hydraulic pump 10 will hereinafter be described as if the shaft 28 is being driven in a predetermined direction by a power source, not shown, for rotating the cylindrical barrel 16 relative to the timing port plate 18 in the usual manner. Moreover, it will be noted that the swash plate 21 is shown in the zero displacement or centered position in the drawings and that clockwise pivotal movement of the swash plate about the pivot pins 23 as viewed in FIGS. 2 and 5 results in fluid being discharged from the port 38 and intake fluid is being received by the port 39. Conversely, counterclockwise pivotal movement of the swash plate results in fluid being discharged through the port 39 while intake fluid is being received by the port 38.

To initiate pivotal movement of the swash plate 21 in the clockwise direction to cause fluid to be discharged through the port 38, the operator manually manipulates the pilot valve 149 rightwardly to direct pressurized pilot fluid into the pilot fluid passage 44. The pilot fluid entering the passage 44 enters the annular chamber 73 of the servo valve 69 and passes through the radial ports 81 into the actuating chamber 92 of the servo valve 69. The pressurized fluid in the actuating chamber 92 moves the valve spool 84 of the servo valve 69 downwardly which causes a series of events to occur either directly or indirectly in a follow-up type of sequence. First of all, downward movement of the valve spool 84 of the servo valve 69 from a neutral fluid blocking position as shown in the drawings establishes communication between the annular groove 86 and the radial passage 83 thereof to establish a flow path from the annular groove to the actuating chamber 57 of the servo actuator 47 through the passageway 106. Simultaneously, the push rod 121 pivots the feedback plate 113 about the pivot pin 116 resulting in the spring 138 being slightly compressed and the push rod 119 moving the valve spool 84 of the servo valve 68 upwardly against the bias of the spring 96 thereof. The upward movement of the valve spool 84 of servo valve 68 causes the control land 88 thereof to establish communication between the radial passages 83 and the lower portion of the bore 78 to establish a flow path from the actuating chamber 57 of the servo actuator 46 to the cavity 14.

The pressurized fluid entering the actuating chamber 57 of the servo actuator 47 moves the piston 56 downwardly thereby pivoting the swash plate 21 clockwise against the bias of the spring 58 of the servo actuator 46. Such pivotal movement of the swash plate 21 causes the opposite push rod 64 to move the piston 56 of the servo actuator 46 upwardly. This upward movement of the piston 56 expels the fluid from the actuating chamber 57 through the passageway 104 and the servo valve 68 into the cavity 14. The pivotal movement of the swash plate rotates the lever 122 about the pin 123 by virtue of the sliding connection between the cylindrical surface 129 of the lever shank 127 and the bore 26 of the swash plate. The pivotal movement of the lever 122 causes the arm 124 to move toward the end portion 117 and the arm 126 to move away from the end portion 118 such that the spring 138 compresses and the spring 139 lengthens. This differential force in the springs 138,139 exerts a feedback force on the feedback plate 113 which in turn pivots about the pin 116 to exert an upward force on the valve spool 84 of the servo valve 69 through the push rod 121 such that the valve spool 84 moves upwardly. The pivotal movement of the swash plate will continue until the differential force in the springs 138 and 139 thus the upward force on the valve spool 84 of the servo valve 69 balances the downward force exerted thereon by the pilot fluid pressure in the actuating chamber 92 of the servo valve 69. In that condition, the control land 88 of the valve spool 84 of servo valve 69 will be essentially in the neutral position to maintain the existing pressure in the actuating chamber 57 of the servo actuator 47 for holding the swash plate at the force balanced position. The displacement of the pump is determined by the pressure level of the pilot fluid in the actuating chamber of the servo valve with the pressure level being controlled by the operator through the positioning of the pilot control valve.

The initial movement of the actuator piston 56 of the servo actuator 46 and thus movement of the swash plate 21 from the centered position is effected by fluid from the pilot pump 148 passing through the check valve 154, the conduit 145, the discharge/intake port 38, the resolver 42 and into the passageway 141. However, as soon as the swash plate moves sufficiently for the pump 10 to start pumping fluid through the port 38, the check valve 154 is closed and the pressurized fluid generated by the pump 10 is thereafter used to power the servo actuator 47.

To return the swash plate 21 to the centered position, the operator needs only to return the pilot valve 149 to the centered position to vent the actuating chamber 92 of the servo valve 69. This simultaneously allows the valve spool 84 of the servo valve 69 to move upwardly and the valve spool 84 of the servo valve 68 to move downwardly by virtue of the energy stored in the springs 138 and 96. Downward movement of the valve spool 84 of the servo valve 68 causes pressurized actuating fluid to be directed into the actuating chamber 57 of the servo actuator 46 to move the piston 56 thereof downwardly to start pivoting the swash plate counterclockwise. The upward movement of the valve spool 84 of the servo valve 69 establishes a flow path between the actuating chamber 57 of the servo actuator 47 and the cavity 14, thereby permitting the piston 56 to move upwardly causing the fluid in the actuating chamber 57 to be exhausted to the cavity 14. As the swash plate pivots counterclockwise, the lever 122 pivots about the pin 123 in the opposite direction to the original movement to move the arm 124 away from the end portion 117 thereby controllably relieving the energy in the spring 138. When the swash plate reaches the centered position, the valve spools 84 block the actuating chambers 57 of both servo actuators 46,47 from the source of actuating fluid so that the swash plate is thus held in the centered position. The counterclockwise pivotal movement of the swash plate is assisted somewhat by the spring 58 of the servo actuator 46.

To initiate pivotal movement of the swash plate 21 in the counterclockwise direction to cause fluid to be discharged through the port 39, the operator manually manipulates the pilot valve 149 in the opposite direction to direct pressurized pilot fluid into the pilot fluid passage 43. This causes the servo valve 68 to direct pressurized actuating fluid to the servo actuator 46 in a manner similar to that described above such that the swash plate 21 pivots in the counterclockwise direction.

The length of the springs 58 of the servo actuators 46,47 is selected so that they are in their free state length when the swash plate 21 is in the centered position. The springs 58 in fact actually center the swash plate in the absence of pressurized fluid in the actuating chambers 57 such as when the pump is not being driven. In contrast thereto, the light weight anti-rattle springs 62 are in a compressed preloaded condition when the swash plate is in the centered position. When the swash plate pivots for example in a clockwise direction, the spring seat 59 of the servo actuator 47 separates from the associated annular shoulder 61. However, the associated anti-rattle spring 62 will maintain a light pressure thereon to keep the spring 58 in contact with the piston 56 thereby preventing the spring 58 from rattling. The strength of the springs 62 is selected to have substantially no effect on the centering of the swash plate.

The springs 138,139 of the feedback mechanism 107 are identical in construction so that they have the same spring rate. It is important in this design for those springs to have the same spring rate so that the swash plate 21 will angularly pivot an equal amount from the centered position in either direction of operation with a given input pressure to the appropriate actuating chamber 92. Stated differently, with the springs 138,139 having the same spring rate, if a pressure of "x" kPa is transmitted to the actuating chamber 92 of the servo valve 69, the swash plate will pivot clockwise "y" degrees. Conversely, if a pressure of "x" kPa is transmitted to the actuating chamber 92 of the servo valve 68, the swash plate will pivot counterclockwise "y" degrees.

The biasing means 94 of the servo valves 68,69 are preassembled, so that a preselected preload is applied to the springs 96. The preload is selected so that the valve spools 84 will not move until the fluid pressure level in the appropriate actuating chamber 92 reaches a predetermined value. It has been found that this arrangement greatly increases the uniformity of operation of the pump. The servo valves 68,69 are preassembled prior to the body 71 being inserted into the valve receiving bores 34,35. Such preassembly includes adjusting the position of the stud 91 relative to the body 71 so that the control land 88 of the valve spool 84 barely closes communication between the annular groove 86 and the radial passages 83 with no force being induced in the biasing means 94. The lock nut 93 is then torqued down to maintain the stud in the adjusted position. The servo valves are then inserted into the valve receiving bores by screwing the threaded portion 77 into the upper threaded portion 79. The position of the valve bodies 71 are then sequentially adjusted so that the forces exerted on the valve spools 84 are balanced while the control lands 88 continue to block the passages 83. The valve bodies 71 are then suitably locked in place with the lock nuts 80.

Operation of the alternate embodiment shown on FIG. 7 is essentially the same as that described above, with the exception that the position of the valve spools 84 is controlled by the solenoids 141 through the stems 142. More specifically, to effect clockwise rotation of the swash plate 21, an electrical signal of predetermined strength is directed to the solenoid 141 attached to the valve body 71 of the servo valve 69 causing the stem to move the associated valve spool 84 downwardly a distance proportional to the strength of the signal. As with the previously described embodiments, downward movement of the spool 84 of the servo valve 69 results in the valve spool 84 of servo valve 68 moving upwardly to establish communication between the actuating chamber 57 of the servo actuator 46 with the cavity 14. As a result pressurized fluid is directed into the actuating chamber 57 of the servo actuator 47 to thus pivot the swash plate 21 clockwise in the same manner as previously described. The feedback mechanism 107 reacts in the manner previously described to exert a balancing force on the valve spool 84 of the servo valve 89 such that the swash plate will stop at a position commensurate with the force being exerted by the solenoid 141 of the servo valve 69 as determined by the strength of the electrical signal.

In view of the foregoing, it is readily apparent that the structure of the present invention provides an improved reversible, variable displacement, hydraulic device which is simplified in design, less expensive to manufacture, and which overcomes the disadvantages of the currently available hydraulic devices. More specifically, by using a pair of cartridge type servo valves which are individually adjustably positioned in the bore of the case of the hydraulic device, the manufacturing tolerances are less restrictive thereby reducing the manufacturing cost. The servo valves being in cartridge form also allows the relative positions of the components to be bench preassembled prior to assembly into the hydraulic device, thereby simplifying the final adjustments of the components to hydraulically center the components for centering the swash plate. Moreover, the servo feedback mechanism is greatly simplified by taking advantage of the adjustability of the servo valves. Also the servo valves use system pressure as the actuating fluid for powering the servo actuators and since the system pressure is significantly higher than the pilot pressure normally used, the servo actuators are smaller thereby reducing the overall size of the device.

Other aspects, objects, and advantages of this invention can be obtained from a study of the drawings, the disclosure, and the appended claims.

We claim:

1. A reversible, variable displacement hydraulic device having a case and a drain cavity defined by the case, an angularly adjustable swash plate resiliently biased to a centered position and moveable in a clockwise direction from the centered position to control the displacement of the device in a first direction of operation and in a counterclockwise direction from the centered position to control the displacement of the device in a second direction of operation, first actuator means for angularly moving the swash plate in the clockwise direction, and second actuator means for angularly moving the swash plate in the counterclockwise direction, comprising:

first and second servo valve means for controlling communication of hydraulic actuating fluid to the first and second actuator means respectively;

an elongate feedback plate pivotally connected to the case and having opposite end portions disposed in operational contact with the first and second servo valve means;

a "T" shaped follow-up lever pivotally connected to the case and having a pair of arms spaced from the end portions of the feedback plate;

a pair of springs disposed between the arms of the lever and the end portions of the feedback plate; and means for connecting the lever to the swash plate so that the lever is pivoted in response to angular movement of the swash plate.

2. The hydraulic device of claim 1 including a support bracket connected to the case, and the follow-up lever and the feedback plate being pivotally connected to the bracket.

3. The hydraulic device of claim 2 wherein the support bracket has a bore therein and the feedback plate has a pair of spaced protruding ears straddling the support bracket and including a pivot pin pivotally connecting the ears to the support bracket.

4. The hydraulic device of claim 3 wherein the follow-up lever has a end portion, said connecting means includes a bore formed in the swash plate and slidably receiving the end portion of the follow-up lever.

5. The hydraulic device of claim 4 wherein said end portion of the follow-up lever has a cylindrical surface formed thereon.

6. The hydraulic device of claim 5 wherein the end portion of the follow-up lever has a notch formed therein.

7. The hydraulic device of claim 4 wherein said case has a supply passageway in communication with both of the servo valve means.

8. The hydraulic device of claim 7 wherein each of the servo valve means includes means defining a valve bore and a valve spool slidably disposed in the valve bore and movable between a neutral position at which the supply passageway is blocked from the respective one of the first and second actuator means and a first position at which the supply passageway communicates with the one servo actuator means and a second position at which the one servo actuator means communicates with the cavity.

9. The hydraulic device of claim 8 wherein each of the servo valve means includes a push rod disposed between the valve spool and the respective end portion of the feedback plate.

10. The hydraulic device of claim 9 wherein the case has a pair of spaced apart parallel valve receiving bores, and each of the servo valve means including a cartridge body disposed within the respective valve receiving bore with the valve bore being formed in the cartridge body.

11. The hydraulic device of claim 10 including means for adjustably retaining the cartridge valve body in the valve receiving bore.

12. The hydraulic device of claim 11 wherein the adjustable retaining means includes a threaded connection between the cartridge body and the case.

13. The hydraulic device of claim 12 wherein the valve bore in the valve body has a threaded portion and including a threaded stud threaded into the threaded portion and defining an actuating chamber at one end of the valve spool.

14. The hydraulic device of claim 13 wherein the case includes a pair of pilot fluid passages in communication with the actuating chambers of the first and second servo valve means.

15. The hydraulic device of claim 14 wherein each of the servo valve means includes biasing means disposed in the actuating chamber for resiliently resisting movement of the valve spool when the valve spool moves from its neutral position toward the second position.

16. The hydraulic device of claim 1 wherein each of the first and second actuator means includes means defining an actuator bore, a piston slidably disposed in the actuator bore and defining an actuating chamber, a push rod disposed between the piston and the swash plate and a control passageway communicating the actuating chamber with one of the servo valve means.

17. The hydraulic device of claim 16 including an actuator spring disposed in each of the actuating chambers and adapted to resiliently bias the swash plate to the centered position in the absence of pressurized fluid in the actuating chambers.

18. The hydraulic device of claim 17 wherein the case has a pair of spaced apart bores, and each of the actuator means includes a cylindrical body disposed in one of the bores in the case with the actuator bore being formed in the body.

19. The hydraulic device of claim 18 including means for releasably retaining the body in the bore in the case.

20. The hydraulic device of claim 19 wherein each of the actuator means includes a spring seat disposed between the body and the actuator spring, and an anti-rattle spring disposed between the body and the spring seat resiliently maintaining the actuator spring in contact with the piston.

21. The hydraulic device of claim 16 wherein said case has a supply passageway in communication with both of the servo valve means.

22. The hydraulic device of claim 21 wherein each of the servo valve means includes means defining a valve bore and a valve spool slidably disposed in the valve bore and movable between a neutral position at which the supply passageway is blocked from the control passageway and a first position at which the supply passageway communicates with the control passageway and a second position at which the control passageway communicates with the cavity.

23. The hydraulic device of claim 22 wherein each of the servo valve means includes a push rod disposed between the valve spool and the respective end portion of the feedback plate.

24. The hydraulic device of claim 23 wherein the case has a pair of spaced apart parallel valve receiving bores, and each of the servo valve means including a cartridge body disposed within the respective valve receiving bore with the valve bore being formed in the cartridge body.

25. The hydraulic device of claim 24 including means for adjustably retaining the cartridge valve body in the valve receiving bore.

26. The hydraulic device of claim 25 wherein the adjustable retaining means includes a threaded connection between the cartridge body and the case.

27. The hydraulic device of claim 26 wherein the valve bore in the valve body has a threaded portion and including a threaded stud threaded into the threaded portion and defining an actuating chamber at one end of the valve spool.

28. The hydraulic device of claim 27 wherein the case includes a pair of pilot fluid passages in communication with the actuating chambers of the first and second servo valve means.

29. The hydraulic device of claim 28 wherein each of the servo valve means includes biasing means disposed in the actuating chamber for resiliently resisting movement of the valve spool when the valve spool moves from its neutral position toward the second position.

30. The hydraulic device of claim 29 wherein the biasing means is free from exerting a biasing force on the valve spool when the valve spool moves from the neutral position to the first position.

31. The hydraulic device of claim 30 wherein said biasing means includes an elongate spring guide having a head in abutment with the valve spool and a stem extending from the head toward the stud, a cup shaped spring retainer slidably disposed on the stem and normally in abutting contact with the stud, a bolt attaching the spring retainer to the stem, and a spring disposed in a preloaded condition between the head and the spring seat.

32. The hydraulic device of claim 26 wherein the valve bore in the valve body has a threaded portion and including a proportional force solenoid threaded into the threaded portion and having a stem extending therefrom and being in abutting engagement with the valve spool.

33. A reversible variable displacement hydraulic device comprising:

a case having a pair of spaced apart, parallel valve receiving bores, a supply passageway in communication with the valve receiving bores, and a case drain cavity defined by the case;

an angularly adjustable swash plate positioned in the drain cavity, said swash plate being resiliently biased to a centered position and moveable in a clockwise direction from the centered position to control the displacement of the device in a first direction of operation and in a counterclockwise direction from the centered position to control the displacement of the device in a second direction of operation;

first actuator means for angularly moving the swash plate in the clockwise direction;

second actuator means for angularly moving the swash plate in the counterclockwise direction;

a pair of cartridge servo valves individually disposed in the valve receiving bores, each of the valves including a valve body positioned in one of the valve receiving bores and having a valve bore opening into the drain cavity, and a valve spool movable between a neutral position blocking communication between the supply passageway and the respective one of the first and second servo actuators, a first position at which the supply passageway communicates with the one servo actuator and a second position at which the one servo actuator is in communication with the drain cavity; and servo feedback means for mechanically moving one of the valve spools to its second position as the other spool is moved to its first position and for moving the spools substantially to their neutral positions when the swash plate reaches a desired angular position after the other spool has first been moved to the first operating position.

34. The hydraulic device of claim 33 wherein the feedback means includes an elongate feedback plate pivotally connected to the case and having opposite end portions disposed in operational contact with the first and second servo valve means; a "T" shaped follow-up lever pivotally connected to the case and having a pair of arms spaced from the end portions of the feedback plate; a pair of springs disposed between the arms of the lever and the end portions of the feedback plate; and means for connecting the lever to the swash plate so that the lever is pivoted in response to angular movement of the swash plate.

35. The hydraulic device of claim 34 including a support bracket connected to the case, the follow-up lever and the feedback plate being pivotally connected to the bracket.

36. The hydraulic device of claim 35 wherein the support bracket has a bore therein and the feedback plate has a pair of spaced protruding ears straddling the support bracket and including a pivot pin pivotally connecting the ears to the support bracket.

37. The hydraulic device of claim 36 wherein the follow-up lever has a cylindrical end portion, said connecting means includes a bore formed in the swash plate and slidably receiving the end portion of the lever.

38. The hydraulic device of claim 37 wherein said end portion of the lever has a cylindrical surface formed thereon.

* * * * *